US006927953B2

(12) United States Patent
Ikeda

(10) Patent No.: US 6,927,953 B2
(45) Date of Patent: Aug. 9, 2005

(54) AUXILIARY ROTATION-SYSTEM STARTER

(75) Inventor: Hirohide Ikeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 173 days.

(21) Appl. No.: 10/289,430

(22) Filed: Nov. 7, 2002

(65) Prior Publication Data

US 2004/0012902 A1 Jan. 22, 2004

(30) Foreign Application Priority Data

Jul. 16, 2002 (JP) ..... 2002-207202

(51) Int. Cl.[7] ..... H02H 5/04; H02H 7/08
(52) U.S. Cl. ..... 361/23; 361/24
(58) Field of Search ..... 361/23, 24; 290/38 R, 290/38 C; 2990/38 R, 38 C

(56) References Cited

U.S. PATENT DOCUMENTS 3,783,301 A * 1/1974 Nieukirk ..... 290/37 R
6,024,065 A * 2/2000 Hojna et al. ..... 123/179.3

FOREIGN PATENT DOCUMENTS

| | | |
|---|---|---|
| JP | 57/192646 | 6/1956 |
| JP | 57-174760 | 11/1982 |
| JP | 9/273464 | 10/1997 |
| WO | WO 00/19091 | 4/2000 |

* cited by examiner

*Primary Examiner*—Brian Sircus
*Assistant Examiner*—Zeev Kitov
(74) *Attorney, Agent, or Firm*—Sughrue Mion, PLLC

(57) ABSTRACT

An auxiliary rotation-system starter includes a starter motor, a main circuit portion having a main contact portion, an auxiliary circuit portion having a driving coil portion for opening or closing the main contact portion, and a fuse for cutting the current flow to the driving coil portion by fusing at a predetermined temperature. The main circuit portion is connected between the starter motor and a power source. The auxiliary circuit portion is connected in parallel with the main contact portion. The fuse is provided in the auxiliary circuit portion.

4 Claims, 8 Drawing Sheets

AUXILIARY ROTATION-SYSTEM STARTER

BACKGROUND OF THE INVENTION

1. Field of the Invention

The present invention relates to an auxiliary rotation-system starter which is used in starting an engine of an automobile for example.

2. Description of the Related Art

FIG. 8 is an electrical connection diagram showing a configuration of a conventional auxiliary rotation-type starter disclosed in Japanese Utility Model Laid-open No. Sho 57-174760. Referring now to FIG. 8, in a conventional auxiliary rotation-system starter 101, a starter motor 102 is electrically connected to a battery power source 105 through a main circuit portion 103 and an auxiliary circuit portion 104 connected in parallel with the main circuit portion 103. The main circuit portion 103 has a main contact portion 106 for enabling or disabling the electrical connection between the battery power source 105 and the starter motor 102. The auxiliary circuit portion 104 has a driving coil portion 107 for opening or closing the main contact portion 106. The auxiliary circuit portion 104 is provided with a relay 108 for enabling or disabling the electrical connection between the battery power source 105 and the driving coil portion 107. In addition, the main circuit portion 103 is provided with a fuse 109. The fuse 109 is disposed between the main contact portion 106 and the starter motor 102.

A pinion gear 110 which serves to be moved axially along with the opening or closing of the main contact portion 106 is coupled to the starter motor 102. In addition, a ring gear 111 which is coupled to an engine is disposed in the vicinity of the pinion gear 110. The pinion gear 110 is engaged with the ring gear 111 due to the movement thereof resulting from the closing of the main contact portion 106.

Next, the operation of the auxiliary rotation-system starter 101 will hereinbelow be described. First of all, closing the relay 108 energizes and activates the driving coil portion 107 and the starter motor 102, respectively. At this time, since the starter motor 102 is activated through the driving coil portion 107, a relatively small torque is supplied to an output shaft of the starter motor 102 to put it into a state of auxiliary rotation. In addition, since the driving coil portion 107 is energized, closing of the main contact portion 106 starts along with the pinion gear 110 being moved towards the side of the ring gear 111. As a result, the pinion gear 110 is moved as it is being auxiliarly rotated.

The pinion gear 110 is brought into contact with the surface of the ring gear 111 due to this movement. At this time, since this operation entails the auxiliary rotation, the pinion gear 110 is slid while being pressed against the surface of the ring gear 111. At this time, when the teeth of the pinion gear 110 have reached the insertion position between the teeth of the ring gear 111 due to the sliding, the teeth of the pinion gear 110 are inserted between the teeth of the ring gear 111 so that the pinion gear 110 is engaged with the ring gear 111. In addition, concurrently with the engagement, the main contact portion 106 is closed. Closing the main contact portion 106 causes a current to flow through the main circuit portion 103 to rotate the starter motor 102 at high speed, thereby cranking the engine.

Although in such an auxiliary rotation-system starter 101, there is a fear that the temperature of the main circuit portion 103 and the auxiliary circuit portion 104 can become extremely high due to, for example long current flow during cranking, the overruns or the like, the fuse 109 provided in the main circuit portion 103 will fuse, thereby preventing this extremely high temperature state from occurring.

However, since the value of the current made to flow through the starter motor 102 during the cranking is larger than that of the current made to flow through the starter motor 102 during the auxiliary rotation, the melting capacity of the fuse 109 provided in the main circuit portion 103 is set with the value of the current made to flow therethrough during cranking as the reference. With such capacity setting for the fuse 109, however, no current during the auxiliary rotation is cut off. For this reason, in the case where the pinion gear 110 is not perfectly engaged with the ring gear 111 due, for example, to catching on an alien substances, scratches or the like for example so that the auxiliary rotation of the starter motor is continuously carried out, there is encountered the problem that the current is made to flow continuously through the driving coil portion 107 for a long time, causing the coil thin film to fuse.

SUMMARY OF THE INVENTION

In the light of the foregoing, the present invention has been made in order to solve the above-mentioned problems associated with the prior art, and it is, therefore, an object of the present invention to provide an auxiliary rotation-system starter which is capable of preventing a driving coil portion from being thermally damaged due to a long current flows during start-up.

According to the present invention, an auxiliary rotation-system starter includes a starter motor, a main circuit portion having a main contact portion, an auxiliary circuit portion having a driving coil portion for opening or closing the main contact portion, and a fuse for cutting the current flow to the driving coil portion by fusing at a predetermined temperature. The main circuit portion is connected between the starter motor and a power source. The auxiliary circuit portion is connected in parallel with the main contact portion. The fuse is provided in the auxiliary circuit portion.

Consequently, auxiliary rotating state is prevented from being maintained for a long time due to the fusing, which makes it possible to prevent the driving coil portion from being melted or thermally damaged.

BRIEF DESCRIPTION OF THE DRAWINGS

The above and other objects as well as advantages of the present invention will become clear from the following description of the preferred embodiments of the present invention with reference to the accompanying drawings, wherein.

DETAILED DESCRIPTION OF THE PREFERRED EMBODIMENTS

The preferred embodiments of the preferred embodiments of the present invention will hereinafter be described in detail with reference to the accompanying drawings.

First Embodiment

Figure 1:
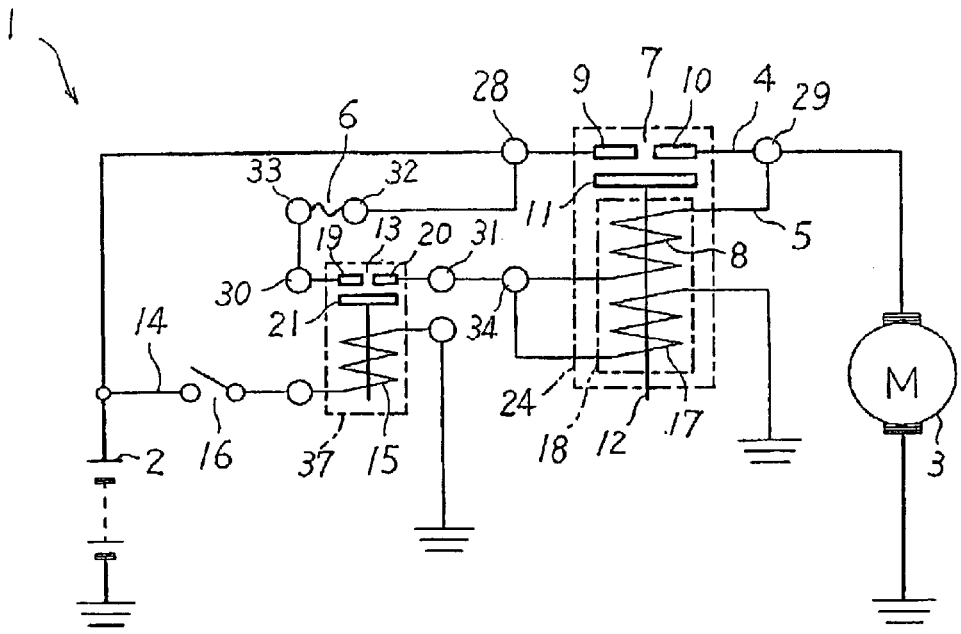
FIG. 1 is an electrical connection diagram showing a configuration of an auxiliary rotation-system starter according to a first embodiment of the present invention.

FIG. 1 is an electrical connection diagram showing a configuration of an auxiliary rotation-system starter according to a first embodiment of the present invention. Referring now to FIG. 1, in an auxiliary rotation-system starter 1, a starter motor 3 is electrically connected to a power source 2 through both a main circuit 4 and an auxiliary circuit portion 5 connected in parallel with the main circuit portion 4. The main circuit 4 has a main contact portion 7 for enabling or disabling the electrical connection between the power source 2 and the starter motor 3. The auxiliary circuit portion 5 has a driving coil portion 8 for opening or closing the main contact portion 7. In addition, the auxiliary circuit portion 5 is provided with a fuse 6, and a relay contact portion 13 for enabling or disabling the electrical connection formed from the power source 2 to the driving coil portion 8 and the starter motor 3. The fuse 6 is disposed between the power source 2 and the relay contact portion 13. Also, the fuse 6 is electrically connected to the power source 2 through a connection terminal 32 and also is electrically connected to the relay contact portion 13 through the connection terminal 33.

In addition, a start-up circuit portion 14 is electrically connected to the power source 2. The start-up circuit portion 14 is provided with a relay coil portion 15 for opening or closing the relay contact portion 13, and a key switch 16 for enabling or disabling the electrical connection between the relay coil portion 15 and the power source 2.

Furthermore, a holding coil portion 17 for opening or closing the main contact portion 7 and keeping the main contact portion 7 closed is connected in parallel with both the driving coil portion 8 and the starter motor 3. It should be noted here that both the driving coil portion 8 and the holding coil portion 17 are electrically connected to the relay contact portion 13 through a connection terminal 34.

The main contact portion 7 includes a power source side fixed contact 9 which is electrically connected to the power source 2 through a connection terminal 28, a starter motor side fixed contact 10 which is electrically connected to the starter motor 3 through a connection terminal 29, and a movable contact 11 which is movably provided in such a way as to be able to contact or part from both the power source side fixed contact 9 and the starter motor side fixed contact 10. The movable contact 11 is mounted to a rod-like movable portion 12 which serves to be driven by causing a current to flow through the driving coil portion 8 and the auxiliary coil portion 17.

The relay contact portion 13 includes a first fixed contact 19 which is electrically connected to the power source 2 through a connection terminal 30, a second fixed contact 20 which is electrically connected to the driving coil portion 8 through a connection terminal 31, and a relay movable contact 21 which is movably provided in such a way as to be able to contact or part from both the first fixed contact 19 and the second fixed contact 20.

Here, the main coil portion 18 is constituted by the driving coil portion 8 and the holding coil portion 17. In addition, an electromagnetic switch 24 is constituted by the main contact portion 7, the main coil portion 18 and the movable portion 12. Moreover, a relay switch 37 is constituted by the relay contact portion 13 and the relay coil portion 15.

Figure 2:
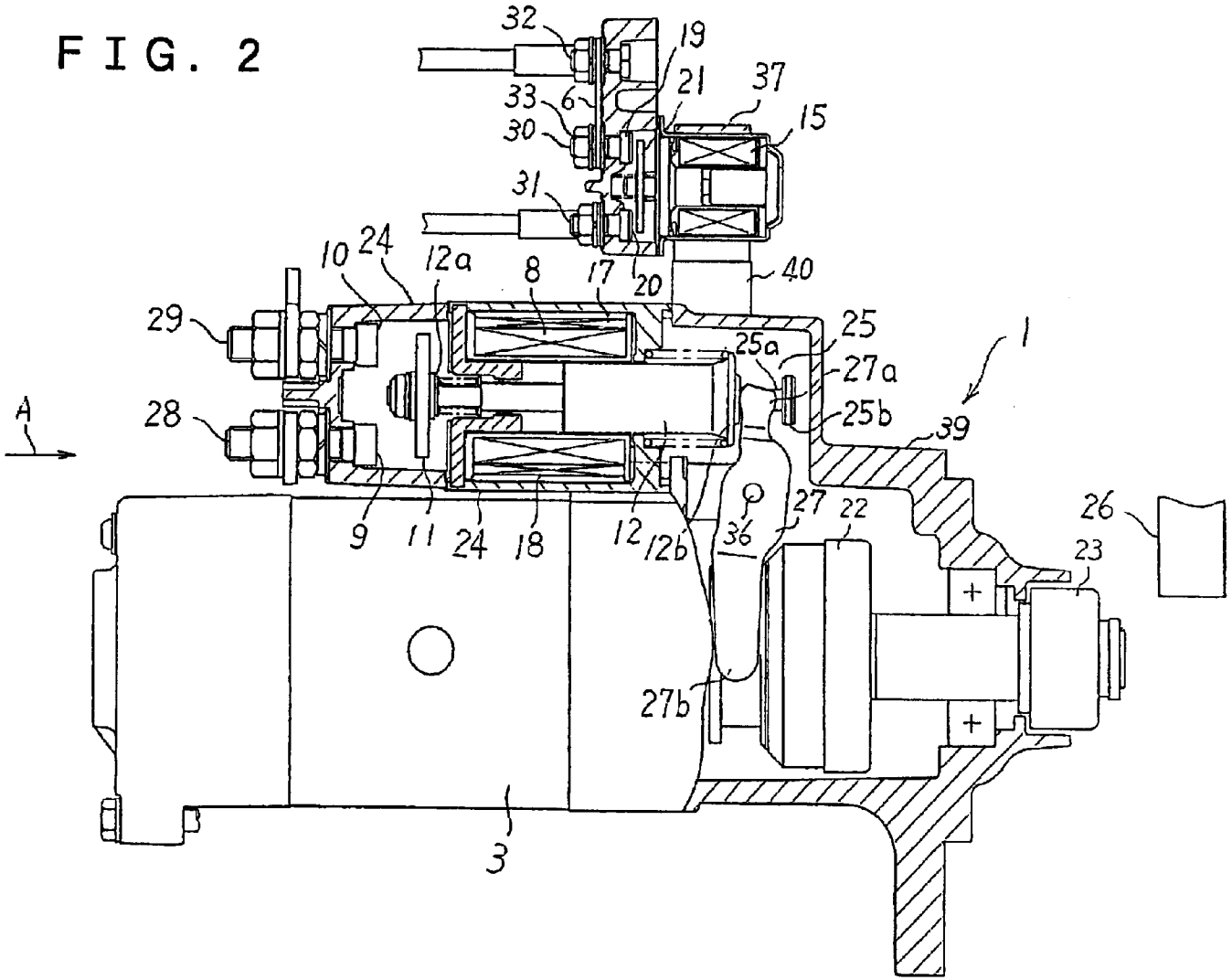
FIG. 2 is a sectional side elevation view of the auxiliary rotation-system starter of the first embodiment shown in FIG. 1.
Figure 3:
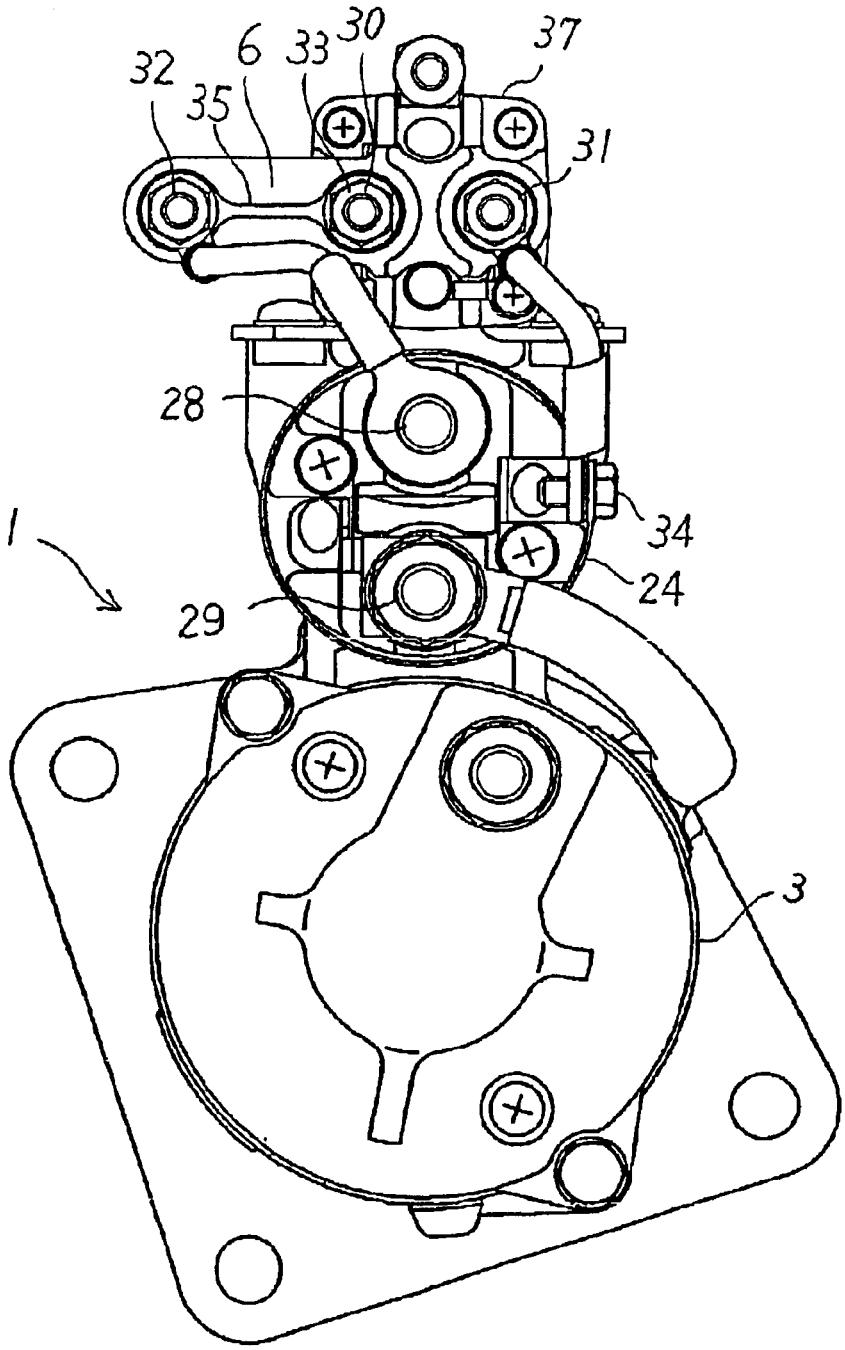
FIG. 3 is a front view when viewed along an arrow A in FIG. 2.

FIG. 2 is a sectional side elevation view of the auxiliary rotation-system starter of the first embodiment shown in FIG. 1, and FIG. 3 is a front view when viewed along arrow A of FIG. 2. Referring now to FIGS. 2 and 3, the starter motor 3 is mounted together with the electromagnetic switch 24 to a housing 39. The pinion gear 23 which serves to be engaged with the ring gear 26 coupled to the engine is coupled to an output shaft of the starter motor 3 through an over-running clutch 22. In addition, the electromagnetic switch 24 is provided adjacent to the starter motor 3 in such a way that the axis of the movable portion 12 becomes parallel with the axis of the starter motor 3. The movable contact 11 is attached to one end portion 12*a* of the movable portion 12, and an engagement portion 25 having a small diameter portion 25*a* and a disc portion 25*b* is formed on the other end portion 12*b* thereof.

In addition, the movable portion 12 and the output shaft of the starter motor 3 are coupled to each other through a lever 27. The lever 27 is pivotably provided on a pin member 36 which is disposed between the axis of the movable portion 12 and the axis of the starter motor 3. Moreover, one end portion 27*a* of the lever 27 is disposed in the small diameter portion 25*a* of the engagement portion 25, and the other end portion 27*b* thereof is disposed between the starter motor 3 and the over-running clutch 22.

The relay switch 37 is mounted to the housing 39 through a mounting member 40. In addition, the relay switch 37 is unitized loaded with the fuse 6.

Here, the fuse 6 has a meltable member 35 which can be melted due to rises in temperatures there at due to the current flow therethrough. The meltable member 35 is adapted to fuse when a time period of the current flow through the main coil portion 18 is longer than that of the current flow therethrough in the normal auxiliary rotating operation. That is to say, the melting temperature of the meltable member 35 is set in such a way that the member 35 should fuse before the driving coil portion 8 has been thermally damaged due to the current flow. The meltable member 35 is made of zinc (Zn: melting temperature of 420° C.) as a material having a lower melting temperature than that of copper (melting temperature of 1,083° C.). The fuse 6 is provided so as to be exposed to the outside in order to allow exchange.

It should be noted here that the connection terminals 28, 29 and 34 are all mounted to the electromagnetic switch 24. In addition, the connection terminals 30 and 31 are both mounted to the fuse 6. Moreover, each of these connection terminals 28 to 34 is constituted by a bolt and a nut.

The auxiliary rotation-system starter 1 constructed as described above operates in the start-up of an engine as follows. First of all, the key switch 16 is turned ON to cause a current to flow through the relay coil portion 15. Then, the relay contact portion 13 is closed through the electromagnetic operation of the relay coil portion 15 due to that current flow. Upon closing the relay contact portion 13, a current is supplied from the power source 2 to the starter motor 3 through the auxiliary circuit portion 5. While this current flow drives the starter motor 3, since the current is made to flow through the driving coil portion 8 as well which is connected in series with the starter motor 3, a relatively small torque is supplied to the output axis of the starter motor 3 to provide an auxiliary rotating state. At this time, the movable portion 12 is also moved through the electromagnetic operation of the driving coil portion 8 and the holding coil portion 17. Along with the movement of the movable portion 12, the movable contact 11 of the main contact portion 7 is moved towards the power source side fixed contact 9 and the starter motor side fixed contact 10, and the one end portion 27*a* of the lever 27 is also moved to pivot around the pin member 36 while being engaged with the engagement portion 25. Along with this pivotal movement, the over-running clutch 22 is pressed by the other end portion 27*b* of the lever 27 to be moved together with the pinion gear 23 in the pressing direction.

Thereafter, the pinion gear 23 is brought into contact with the surface of the ring gear 26. At this time, since this movement entails the auxiliary rotation, the pinion gear 23 is slid while being pressed against the surface of the ring gear 26. At the time when the teeth of the pinion gear 23 have reached the insertion position between the teeth of the ring gear 26 through this sliding movement, the teeth of the pinion gear 23 are inserted between the teeth of the ring gear 26 so that the pinion gear 23 is engaged with the ring gear 26. At this time, the movable contact 11 of the main contact portion 7 also comes into contact with both the power source side fixed contact 9 and the starter motor side fixed contact 10 to close the main contact portion 7.

Since the potential difference barely develops across the connection terminals 29 and 30 of the driving coil portion 8 after the main contact portion 7 has been closed, only a small quantity of current required to keep the main contact portion 7 closed is made to flow through the holding coil portion 17, while most of the current is supplied to the starter motor 3 through the main circuit portion 4. At this time, a large torque is supplied to the output axis of the starter motor 3 to provide the cranking state.

In the case where the pinion gear 23 is not perfectly engaged with the ring gear 26 for some reason or other, e.g., deformation or the like of the pinion gear 23 or the ring gear 26, even if a current is made to flow through the auxiliary circuit portion 5, the main contact portion 7 is not closed at all. In such a manner, if the state in which the main contact portion 7 is not closed, even though the current is made to flow through the auxiliary circuit portion 5, i.e., the auxiliary rotating state continues, then the temperature of the auxiliary circuit portion 5 rises. Thereafter, the meltable member 35 of the fuse 6 is fused before the auxiliary circuit portion 5 becomes abnormally hot due to the rise in the temperature.

Consequently, in such an auxiliary rotation-system starter 1, even when the pinion gear 23 is not perfectly engaged with the ring gear 26 for some reason or other, the auxiliary rotating state is prevented from being maintained for a long time due to the fusing, which makes it possible to prevent the coil thin film of the driving coil portion 8 from being melted or thermally damaged.

In addition, since the fuse 6 is not provided in the main circuit portion 4 through which a large current is made to flow in the cranking state, but is provided in the auxiliary circuit portion 5 to which the driving coil portion 8 is connected, it is possible to set the cut-off capacity to the value of the current flowing through the driving coil portion 8 as the reference, and also it is possible to prevent the coil thin film of the driving coil portion 8 from being melted or thermally damaged with the value of the current flowing through the main circuit portion 4 in the cranking state being ensured.

In addition, since the meltable member 35 of the fuse 6 is made of zinc having a lower melting temperature than that of copper, it is possible to suppress that thermal damage, etc, to the peripheral parts or components, e.g., a supporting member for the fuse 6. Moreover, since the meltable member 35 can be made in such a way that its temperature reaches its melting temperature due to the long current flow without its cross section being made extremely small, the cut-off capacity at a small level can be ensured while strength is maintained. As a result, for the meltable member 35, the occurrence of cutting due to vibration for example is also suppressed.

In addition, since the fuse 6 is mounted so as to be exposed to the outside, even when it fuses, it can be readily exchanged for a new one.

Second Embodiment

Figure 4:
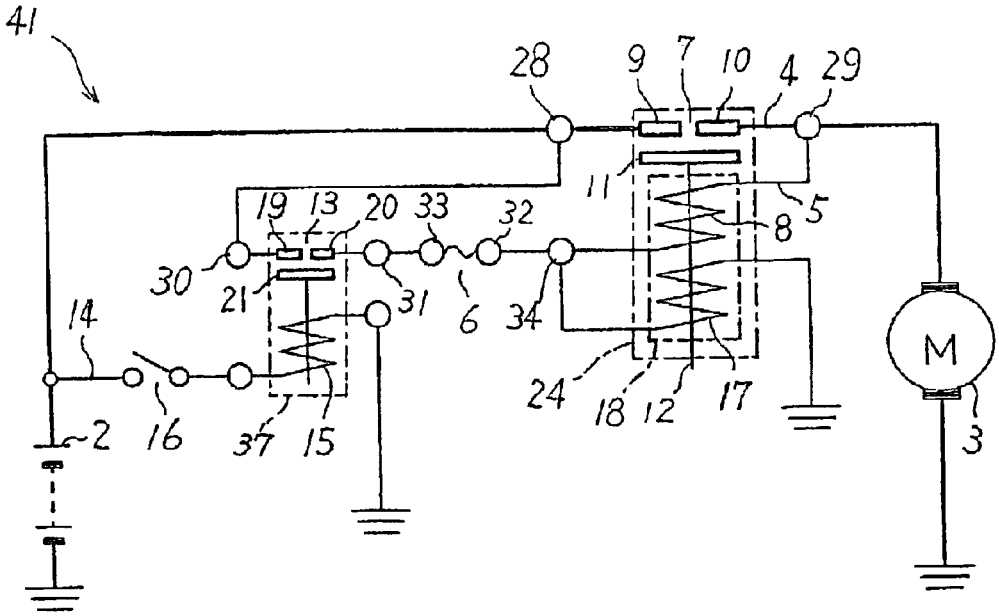
FIG. 4 is an electrical connection diagram showing a configuration of an auxiliary rotation-system starter according to a second embodiment of the present invention.
Figure 5:
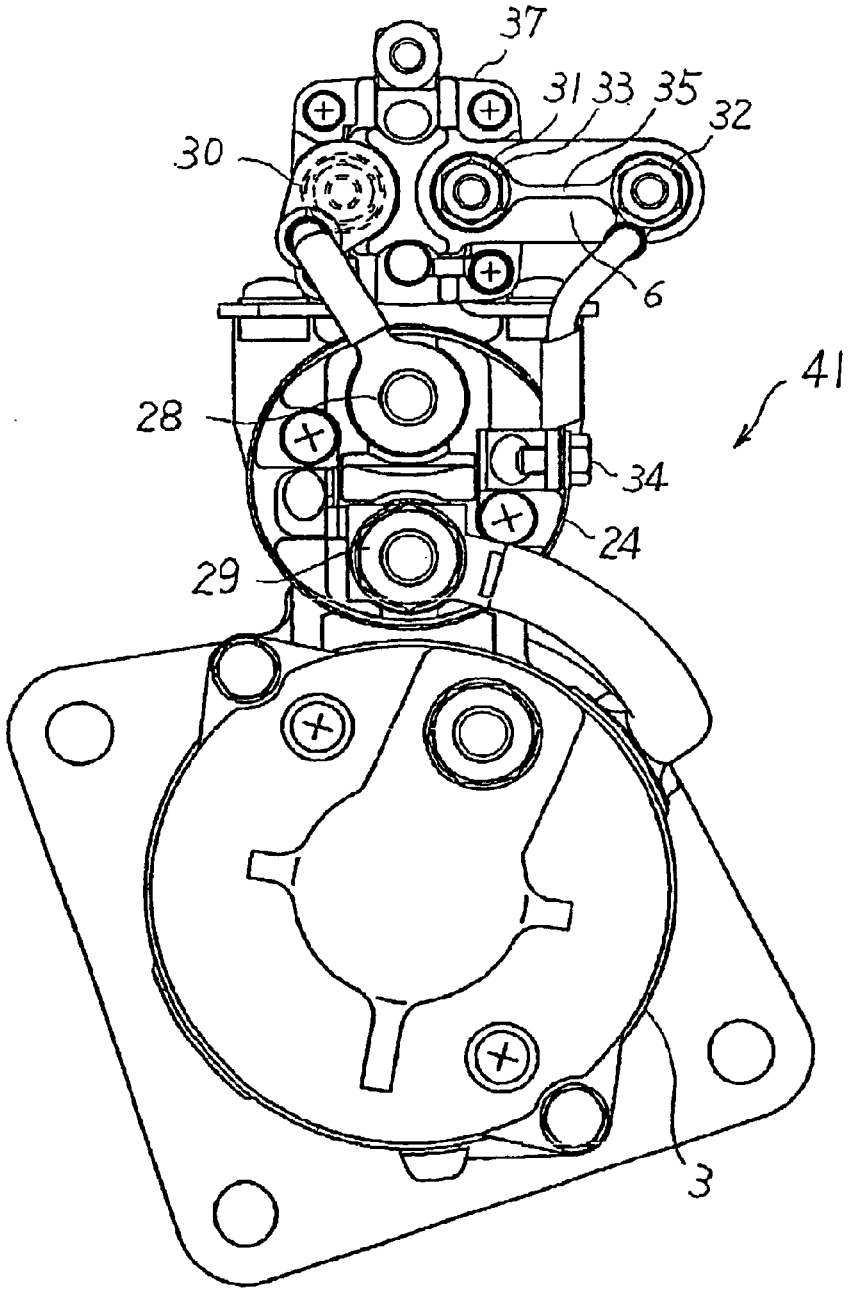
FIG. 5 is a front view showing construction of the auxiliary rotation-system starter of the second embodiment shown in FIG. 4.

FIG. 4 is an electrical connection diagram showing a configuration of an auxiliary rotation-system starter according to a second embodiment of the present invention. Also, FIG. 5 is a front view showing construction of the auxiliary rotation-system starter of the second embodiment shown in FIG. 4. Referring now to FIGS. 4 and 5, a fuse 6 in an auxiliary rotation-system starter 41 is provided between a relay contact portion 13 and a main coil portion 18 of an auxiliary circuit portion 5. That is to say, a connection terminal 33 for the fuse 6 is electrically connected to a connection terminal 31 of a relay contact portion 13, and a connection terminal 32 therefore is electrically connected to a terminal 34 of a main coil portion 18. It should be noted here that connection terminal 28 and connection terminal 30 are electrically connected to each other without going through a fuse.

Other constituent elements in the configuration are the same as those of the first embodiment.

Consequently, since the fuse 6 is provided in the auxiliary circuit portion 5 of in the auxiliary rotation-system starter 41 as well, it is possible to set the cut-off capacity with the value of the current flowing through the drive coil portion 8 as the reference and to prevent the coil thin film of the driving coil portion 8 from being melted or thermally damaged with the value of the current flowing through the main circuit portion 4 in the cranking state being secured.

In addition, since the meltable member 35 of the fuse 6 is made of zinc having a lower melting temperature than that of copper, it is possible to suppress thermal damage in peripheral parts or components, e.g., a supporting member for the fuse 6, and the like. Moreover, since the meltable member 35 can be made in such a way that it reaches melting temperature due to long current flow without its cross section being made extremely small, the cut-off capacity can be ensured at a lower level while still maintaining strength. As a result, for the meltable member 35, the occurrence of breakage due to vibration, for example, is also suppressed.

In addition, since the fuse 6 is mounted so as to be exposed to the outside, even when it fuses, it can be readily exchanged for a new one.

Third Embodiment

Figure 6:
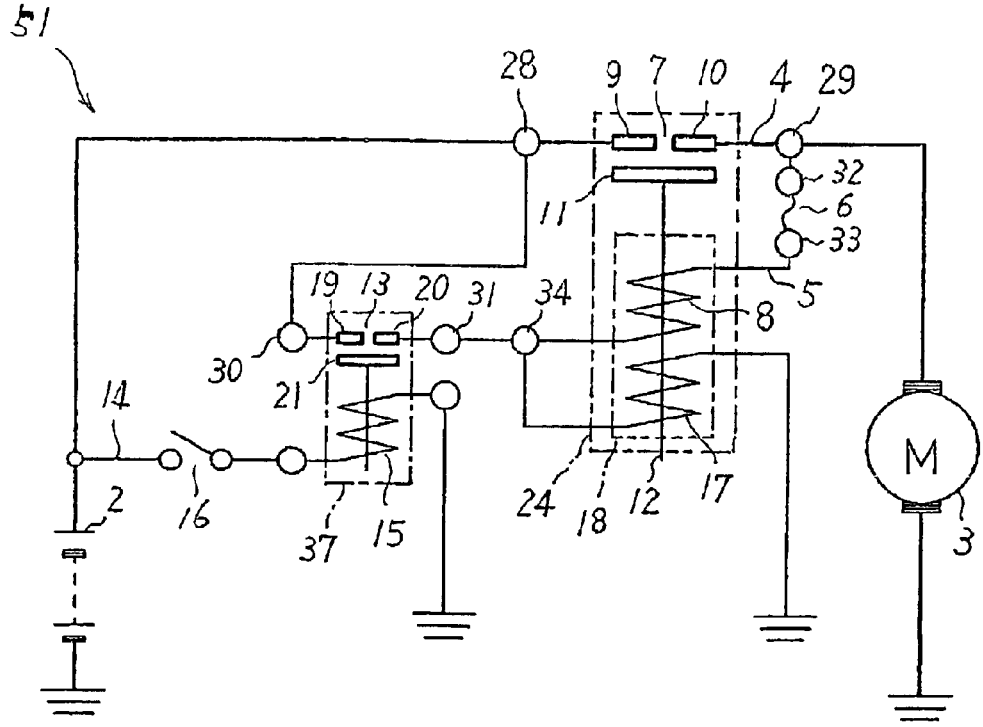
FIG. 6 is an electrical connection diagram showing a configuration of an auxiliary rotation-system starter according to a third embodiment of the present invention.
Figure 7:
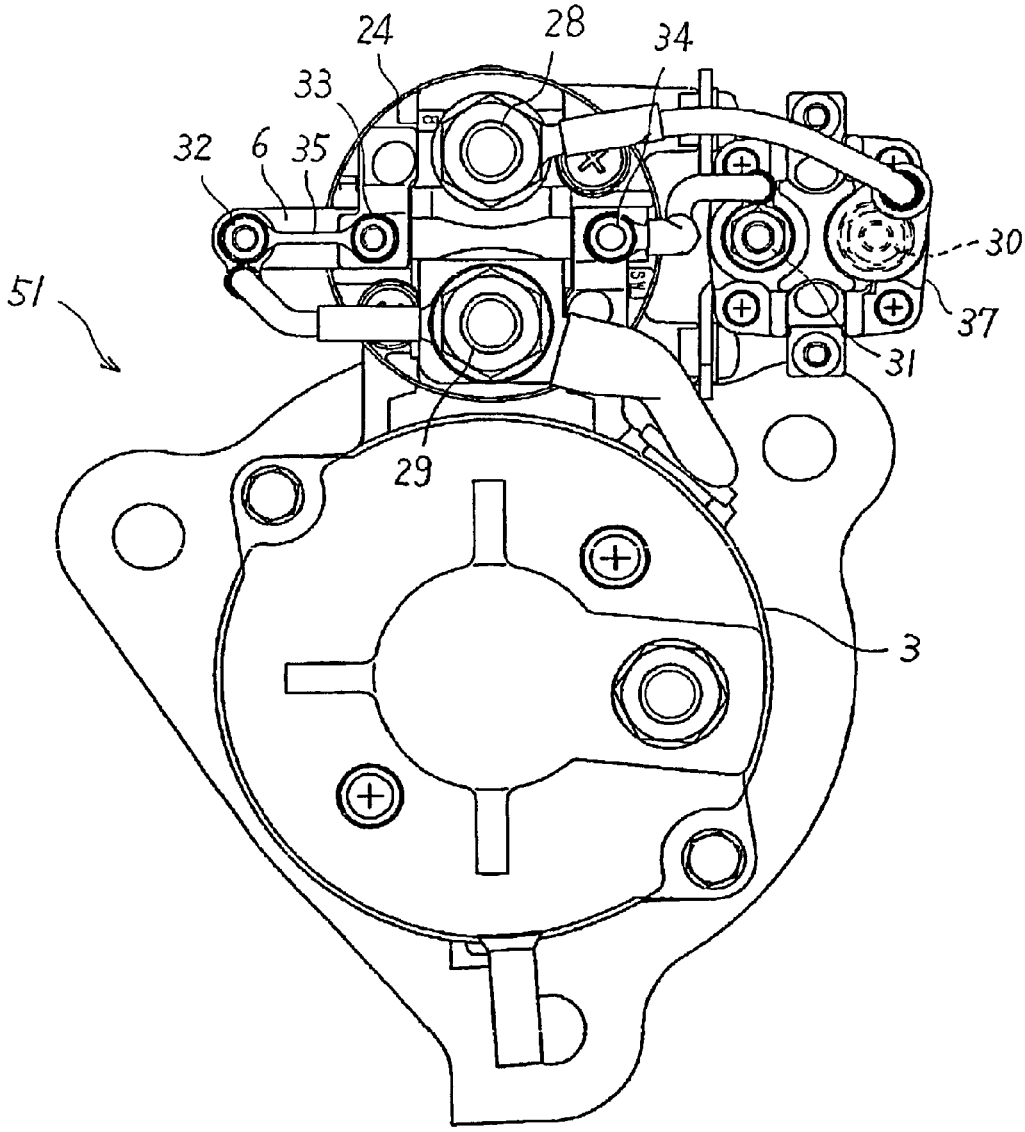
FIG. 7 is a front view showing construction of the auxiliary rotation-system starter of the third embodiment shown in FIG. 6.
Figure 8:
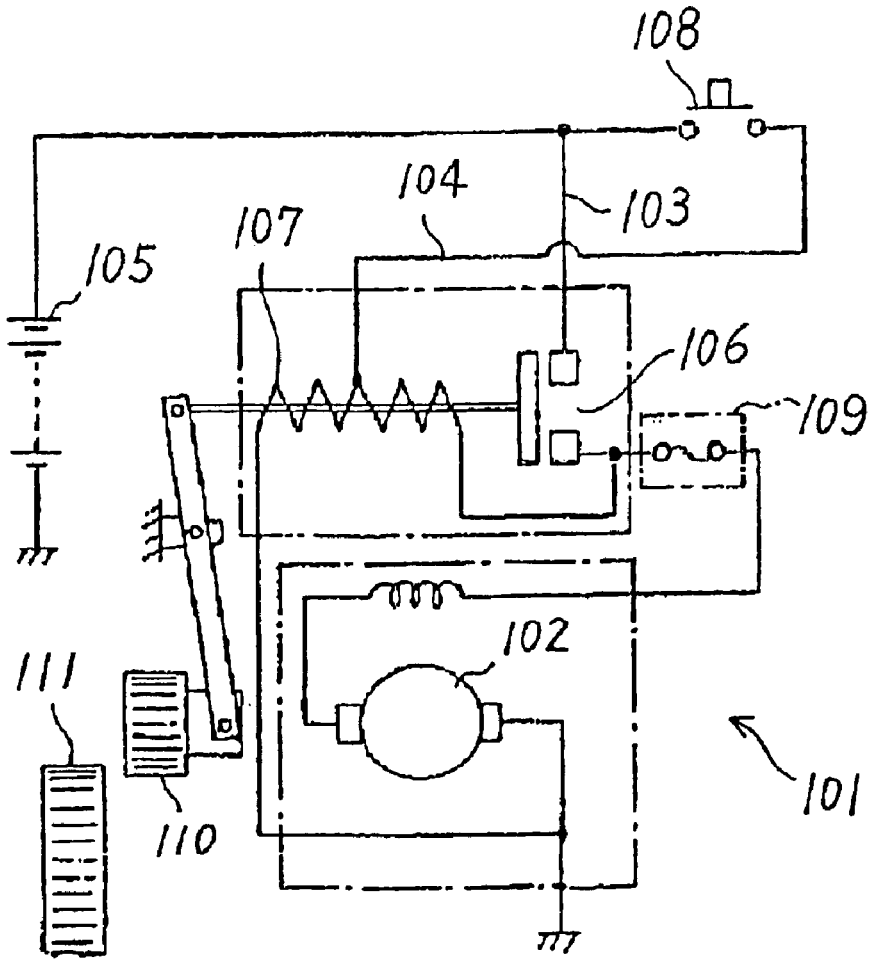
FIG. 8 PRIOR ART
FIG. 8 is an electrical connection diagram showing a configuration of a conventional auxiliary rotation-system starter.

FIG. 6 is an electrical connection diagram showing a configuration of an auxiliary rotation-system starter according to a third embodiment of the present invention. Also, FIG. 7 is a front view showing construction of the auxiliary rotation-system starter of the third embodiment shown in FIG. 6. Referring now to FIGS. 6 and 7, a fuse 6 in an auxiliary rotation-system starter 51 is provided in an auxiliary circuit portion 5. In addition, the fuse 6 is provided between a driving coil portion 8 and a starter motor 3. That is to say, a connection terminal 33 for the fuse 6 is electrically connected to the driving coil portion 8, and a connection terminal 32 therefore is electrically connected to a connection terminal 29. In addition, the fuse 6 is not mounted to a relay switch 37, but is mounted to an electromagnetic switch 24. It should be noted here that connection terminal 28 and connection terminal 30 are electrically connected to each other without going through a fuse.

Other constituent elements in this configuration are the same as those of the first embodiment.

Consequently, the auxiliary rotation-system starter 51 of the third embodiment offers the same effect as that of the first embodiment. Also, since the fuse 6 is mounted to the electromagnetic switch 24, even when the relay switch 37 is not mounted on from the auxiliary rotation-system starter 51, a generally used relay switch is connected to the auxiliary rotation-system starter 51, whereby it is possible to prevent the auxiliary rotating state from being maintained for a long time. Consequently, any of the relay switches can be applied irrespective of specification as long as it has a contact point opening/closing capacity with which a current flowing through the auxiliary circuit portion 5 in the normal auxiliary rotating operation can be cut off.

It should be noted here that in the first and second embodiments as well, since in the auxiliary rotation-system starter, the fuse 6 may also be mounted to the electromagnetic switch 24, similar to the foregoing, any relay switch which are generally used may also be applied thereto.

In addition, in the above-mentioned first to third embodiments, since the meltable member of the fuse may also be made of a material having a lower melting temperature than that of copper, the meltable member may be made of a material which is selected from the group consisting of zinc alloy, tin (Sn: melting temperature 232° C.), lead (Pb: melting temperature 327° C.), alloy thereof and aluminum (Al: melting temperature 660° C.) for example. Since the meltable member made of such a material has a larger cross section than that of the meltable member made of copper, both of anti-shock characteristics and the cut-off capacity are ensured. Consequently, the meltable member may be made of any of electrically conductive materials a melting temperature of which is in the range of about 200 to about 700° C.

While the present invention has been particularly shown and described with reference to the preferred embodiments and the specified modifications thereof, it will be understood that various changes and other modifications will occur to those skilled in the art without departing from the scope and spirit of the invention. The scope of the invention is, therefore, to be determined solely by the appended claims.

What is claimed is:

1. An auxiliary rotation-system starter, comprising:

a starter motor which is adapted to be driven by making a current to flow from a power source therethrough;

a main circuit portion connected between said starter motor and said power source and having a main contact portion;

an auxiliary circuit portion having a driving coil portion for opening or closing said main contact portion and connected in parallel with said main contact portion;

a holding coil portion which keeps said main contact portion closed and is connected to said auxiliary circuit portion; and a fuse provided in said auxiliary circuit portion, for cutting off the current flow only to said driving coil portion and said holding coil portion by fusing at a predetermined temperature;

wherein said driving coil portion, said holding coil portion and said fuse are mounted on said starter motor.

2. An auxiliary rotation-system starter according to claim 1, wherein said fuse is provided between said starter motor and said driving coil portion.

3. An auxiliary rotation-system starter according to claim 1, wherein a melting temperature of said meltable member is set in such a way that said meltable member fuses before said driving coil portion is thermally damaged due to the current flow therethrough.

4. An auxiliary rotation-system starter according to claim 1, wherein said meltable member is made of a material having a melting temperature lower than that of copper.

* * * * *